US010254038B2

(12) United States Patent
Jung

(10) Patent No.: US 10,254,038 B2
(45) Date of Patent: Apr. 9, 2019

(54) REFRIGERATOR

(71) Applicant: LG ELECTRONICS INC., Seoul (KR)

(72) Inventor: Jiwon Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/712,710

(22) Filed: Sep. 22, 2017

(65) Prior Publication Data

US 2018/0094848 A1 Apr. 5, 2018

(30) Foreign Application Priority Data

Oct. 4, 2016 (KR) ..... 10-2016-0127847

(51) Int. Cl.

| | |
|---|---|
| ***F25D 21/08*** | (2006.01) |
| ***F25D 11/02*** | (2006.01) |
| ***F25D 21/14*** | (2006.01) |
| ***F25D 23/00*** | (2006.01) |
| ***F25D 21/06*** | (2006.01) |

(52) U.S. Cl.

CPC ..... *F25D 21/08* (2013.01); *F25D 11/02* (2013.01); *F25D 21/06* (2013.01); *F25D 21/14* (2013.01); *F25D 23/006* (2013.01); *F25D 2321/142* (2013.01)

(58) Field of Classification Search

CPC ..... F25D 21/06; F25D 21/08; F25D 2400/04; F25D 11/02; F25D 21/14; F25D 23/006; F25D 2321/142

See application file for complete search history.

(56) References Cited

U.S. PATENT DOCUMENTS

| | | | |
|---|---|---|---|
| 3,436,931 | A | 4/1969 | Gelbard |
| 5,042,267 | A | 8/1991 | Beers |

(Continued)

FOREIGN PATENT DOCUMENTS

| | | | |
|---|---|---|---|
| JP | 2003004361 | A | 1/2003 |
| JP | 2004020003 | A | 1/2004 |

(Continued)

OTHER PUBLICATIONS

Extended European Search Report in European Application No. 17191724.8, dated Feb. 21, 2018, 10 pages.

*Primary Examiner* — Melvin Jones

(74) *Attorney, Agent, or Firm* — Fish & Richardson P.C.

(57) ABSTRACT

A refrigerator includes a cabinet, a refrigerant pipe extending in a vertical direction, a plurality of heat-exchange fins through which the refrigerant pipe passes, a pair of frames supporting both sides of the refrigerant pipe, an auxiliary defrost heater provided at an upper portion of the refrigerant pipe and configured to heat an upper region of the refrigerant pipe during a defrosting operation, a defrost heater disposed below a lower end of the refrigerant pipe and configured to heat the refrigerant pipe and air outside the refrigerant pipe during the defrosting operation, and a defrost heater cover disposed between the defrost heater and the lower end of the refrigerant pipe and covering an upper portion of the defrost heater. The defrost heater cover defines a plurality of air holes that allow air heated by the defrost heater to flow upward to the refrigerant pipe.

18 Claims, 21 Drawing Sheets

(56) References Cited

U.S. PATENT DOCUMENTS

| | | | | |
|---|---|---|---|---|
| 2006/0139515 | A1* | 6/2006 | Baek | G02B 5/201 349/106 |
| 2008/0202141 | A1* | 8/2008 | Lim | F25B 39/022 62/285 |
| 2010/0115982 | A1* | 5/2010 | Kim | F25D 17/067 62/419 |

FOREIGN PATENT DOCUMENTS

| | | | |
|---|---|---|---|
| JP | 2004190959 | A | 7/2004 |
| KR | 10-2006-0028126 | | 3/2006 |

* cited by examiner

REFRIGERATOR

CROSS-REFERENCE TO RELATED APPLICATIONS

This application claims priority under 35 U.S.C. 119 and 35 U.S.C. 365 to Korean Patent Application No. 10-2016-0127847 filed on Oct. 04, 2016 in Korea, the entire contents of which is hereby incorporated by reference in its entirety.

BACKGROUND

The present invention relates to a refrigerator.

Generally, a refrigerator is a household appliance that allows food to be stored at a low temperature in an internal storage space that is shielded by a door and is configured to store foods in optimal condition by cooling an inside portion of the storage space using cool air generated through heat exchange with a refrigerant circulating in a refrigeration cycle.

Such a refrigerator has been becoming larger and multi-functional as the dietary life changes and users' preferences vary, and a refrigerator having various structures and convenience devices for convenience of users and freshness of stored food is being marketed.

Typically, in the refrigerator, moisture in the refrigerator can be attached to an evaporator by repeated cooling operation. In a case where excessive moisture is attached to the evaporator and frost is generated, there is a problem that the efficiency of heat exchange with the evaporator is lowered and flow of a cool air path in the space where the evaporator is disposed is blocked and thus the flow of cool air is obstructed.

In order to solve such a problem, a refrigerator has been developed in which a heater is installed in the evaporator, and the heater is operated in a defrosting operation, which is performed every predetermined period, so as to melt frost attached to the evaporator.

Representatively, Korean Patent Laid-Open Publication No. 10-2006-0028126 discloses a refrigerator having a heater cover for preventing the defrost water falling from the evaporator from contacting a heater main body.

However, there is a problem that structure for mounting the heater cover is complicated in such a technique of the related art.

In addition, there is a problem that air in the refrigerator is moved from the lower side to the upper side of the evaporator and, at this time, the flow of air is lowered by the heater cover.

In addition, there is a problem that the heat generated from the heater main body can be shielded by the heater cover at the upper side thereof, flow of hot air in the upper direction is restricted, and thus defrost efficiency is lowered.

SUMMARY

An objective of an embodiment of the present invention is to provide a refrigerator that can prevent defrost water generated during defrosting from flowing into a defrost heater and simultaneously flow heat of the defrost heater in the upper direction.

An objective of an embodiment of the present invention is to provide a refrigerator which can easily install a defrost heater cover for preventing the falling of the defrost water.

According to an embodiment of the present invention, there is provided a refrigerator including: a cabinet in which a refrigerating chamber and a freezing chamber defined in a lateral direction by a barrier are formed; a refrigerant pipe which is disposed at a rear side of the freezing chamber and extends in the vertical direction while being bent a plurality of times; a plurality of heat exchange fins which penetrates the refrigerant pipe; a pair of frames which supports the refrigerant pipe at both sides; an auxiliary defrost heater which is provided on an upper portion of the refrigerant pipe and heats an upper region of the refrigerant pipe during an defrosting operation; a defrost heater which is disposed to be spaced apart from a lower end of the refrigerant pipe and heats the refrigerant pipe from below during the defrosting operation; and a defrost heater cover which is provided between the refrigerant pipe and the defrost heater and shields the defrost heater from above, in which a plurality of air holes is formed in the defrost heater cover which is formed to penetrate the defrost heater cover and through which air heated by the defrost heater is passed to flow to the refrigerant pipe.

The air holes may be formed to have a diameter of 1 mm to 3 mm in order to have a size through which the defrost water is not passed due to surface tension thereof.

An insertion portion which penetrates and inserted into the frame; and a fixed portion which is bent to be in contact with an inside surface of the frame and is coupled to the frame by a coupling member may be formed in both ends of the defrost heater cover.

A cutout portion which is cut inwardly to facilitate bending forming of the defrost heater cover may be formed between the insertion portion and the fixed portion.

The defrost heater cover is bent so that both sides thereof have a downward slope about a center portion extending in the longitudinal direction thereof and the cutout portion may be formed at both ends of the center portion.

Both end portions of the defrost heater cover may be bent downwardly to form an extension portion for guiding the defrost water flowing down along the defrost heater cover to the outside of the defrost heater.

A bracket mounting portion for fastening a coupling member to which the cover bracket is detachably coupled is formed in the extension portion.

The defrost heater cover may include a cover bracket which extends in the upper direction and is detachably coupled to a lower end of the refrigerant pipe.

A cover bracket may further provided which extends in the vertical direction and has a lower end coupled to the defrost heater cover and an upper end engaged with the refrigerant pipe so that the defrost heater cover can be mounted on the refrigerant pipe in a suspended state.

The defrost heater cover may include a first inclined surface and a second inclined surface that are inclined in a direction symmetrical to each other about a center of the defrost heater, in which the air holes may be formed in the first inclined surface and the second inclined surface, respectively.

An extended end portions of the first inclined surface and the second inclined surface may be positioned at an outside of the outer surface of the defrost heater.

An extension portion which is bent from the outside of the defrost heater in the lower direction may be further formed on extending end portions of the first inclined surface and the second inclined surface.

An insertion portion inserted through the frame and a fixed portion bent to be in contact with the inside surface of the frame and coupled to the frame by a coupling member are respectively formed on both ends of a first inclined surface and a second inclined surface which are in contact with the frame and the insertion portion and the fixed portion of the first inclined surface may be positioned in directions opposite to each other with respect to the insertion portion and the securing portion of the second inclined surface.

The defrost heater cover includes an inclined surface inclined such that defrost water falling from above is directed toward the outside of the defrost heater and the air hole may be formed on the inclined surface.

The defrost heater cover may be further formed with a shielding portion which is bent upwards after being cut for shaping of the air hole and shields the air holes from above.

The defrost heater cover includes a flat surface portion which extends along a longitudinal direction of the defrost heater and an inclined portion which is bent to have a downward inclination toward the outside of the defrost heater along both ends of the flat surface portion, in which the air hole may be formed along the flat surface portion.

The flat surface portion is disposed vertically below the refrigerant pipe and may be formed to be horizontal with a bottom surface of the refrigerator.

The defrost heater cover includes an inclined surface which has a downward inclination such that defrost water falling from above is directed to the outside of the defrost heater; and a plurality of recessed portions which are recessed from an upper end to a lower end of the inclined surface and guide the defrost water to the outside of the defrost heater, in which the air holes can be formed between the recessed portions which are continuously disposed at fixed intervals.

A protrusion portion which protrudes to be inclined or rounded upward is formed between the recessed portions and the air hole may be formed at the protruded end portion of the protrusion portion.

The inclined surface may include a first inclined surface and a second inclined surface which have a downward inclination to both sides of the defrost heater from the center portion toward the outside of the defrost heater cover.

The refrigerator according to the embodiment of the present invention may be expected to have the following effects.

The defrost heater according to the embodiment of the present invention is covered so that the defrost water falling from above the defrost heater is not directed to the defrost heater during the defrosting operation.

The defrost heater cover is formed with an extension portion extending downward at both ends of an inclined upper surface so that water flowing along the inclined surface can fall downward to the outside of the defrost heater and extend downward and the frost water does not fall to the defrost heater even in the disposition of the refrigerator in an inclined state and thus there is an advantage that noise generated by contact with the frost water being in contact with each other and the defrost heater can be prevented.

Particularly, the air hole is formed in the inclined surface of the defrost heater cover to allow the water which falls to the defrost heater cover not to pass through the defrost heater cover and to allow the heat of the defrost heater to pass therethrough and thus efficiency of the defrosting operation can be improved.

The fixed portion and the insertion portion are formed on both ends of defrost heater cover and thus the defrost heater cover can be easily installed to the frame, and rotation of the defrost heater cover is prevented and temporary assembly thereof can be performed and thus assembling workability and productivity can be improved.

In addition, there is an advantage that the cutout portion is formed on both ends of the defrost heater cover to easily perform the bending work of the plate-shaped defrost heater, and breakage or defects that may occur during the shaping process of the defrost heater cover can be prevented.

A cover bracket mounting portion is formed on the defrost heater cover, and the defrost heater cover can be hooked and mounted on the refrigerant pipe by the cover bracket. Therefore, there is an advantage that it is possible to easily additionally mount the defrost heater cover on the evaporator of the refrigerator in a state of being already installed and it is possible to effectively respond to service requests of the consumer.

In addition, there is an advantage that since the simple mounting using the cover bracket can be performed without separate fastening structures, the convenience of installation and assembly mounting can be improved.

DETAILED DESCRIPTION OF THE EMBODIMENTS

Hereinafter, specific embodiments of the present invention will be described in detail with reference to the drawings. However, there is no intention to limit the present invention to the embodiments in which spirit of the present invention is provided and other embodiments which is included in the range of spirit of the other degenerative inventions or the present invention can be easily proposed by adding, changing, deleting or the like of another component.

Figure 1:
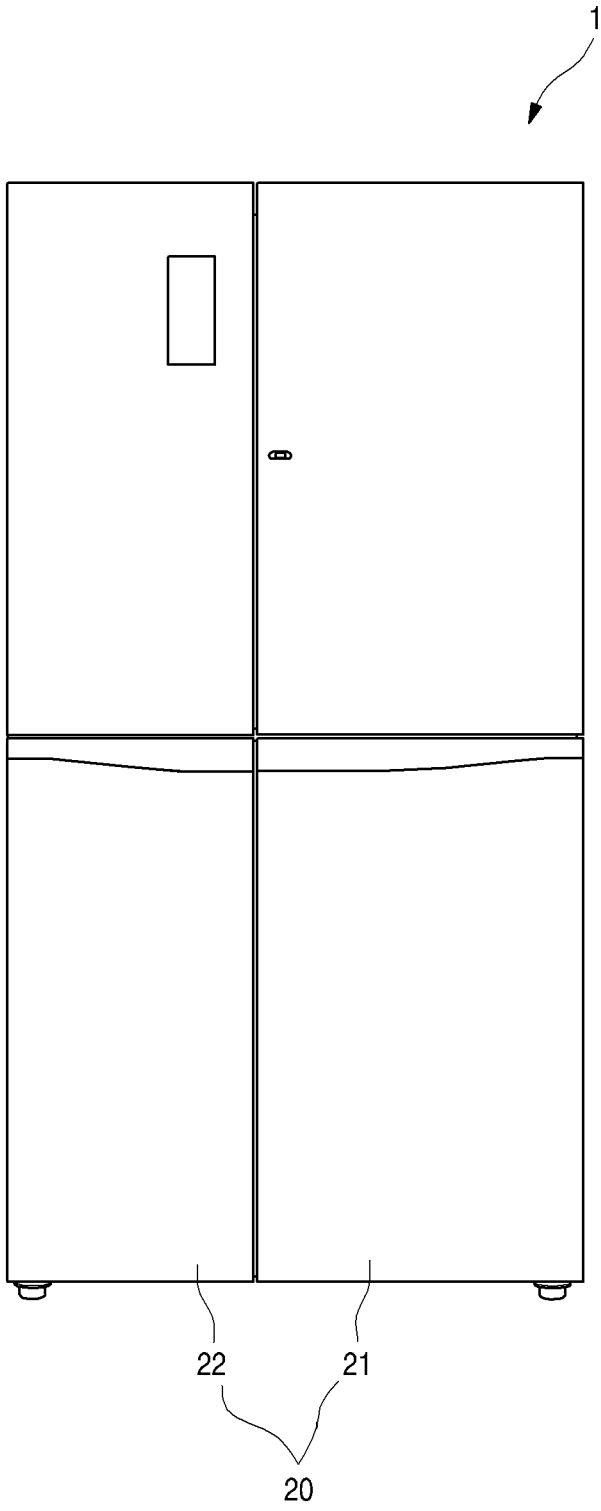
FIG. 1 is a front view illustrating a refrigerator according to a first embodiment of the present invention.
Figure 2:
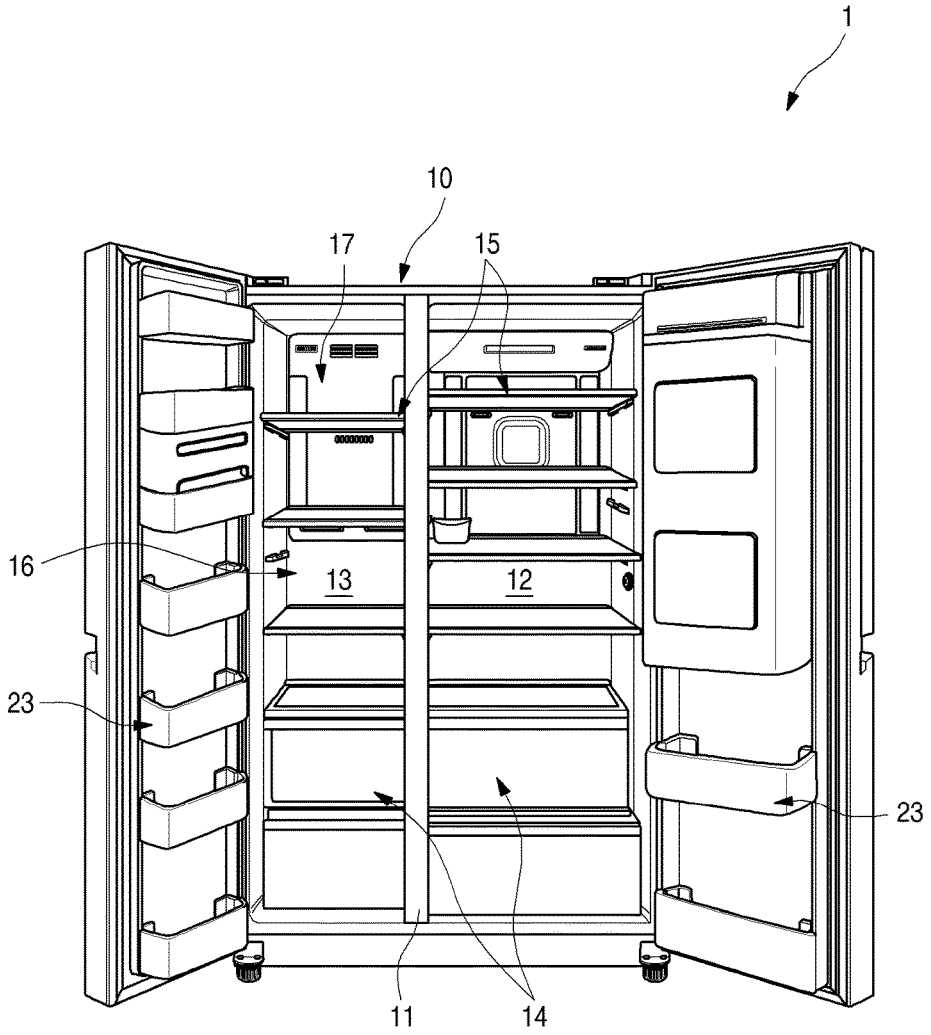
FIG. 2 is a front view illustrating a state where a door of the refrigerator is opened.

FIG. 1 is a front view illustrating a refrigerator according to a first embodiment of the present invention. FIG. 2 is a front view illustrating a state where a door of the refrigerator is opened.

As illustrated in drawings, an outer appearance of a refrigerator 1 according to an embodiment of the present invention can be formed by a cabinet 10 that forms a storage space and a door 20 which is mounted on the cabinet 10 and opens and closes the storage space.

An inside of the cabinet 10 can be divided into both sides in the lateral direction by a barrier 11. In other words, the storage space is divided by the barrier 11 and a refrigerating chamber 12 and a freezing chamber 13 can be formed in the cabinet 10.

The door 20 may include a refrigerating chamber door 21 and a freezing chamber door 22 which are independently opened and closed an opened front surface of the cabinet 10. The refrigerating chamber door 21 and the freezing chamber door 22 are mounted on the cabinet 10 to be rotatable and the refrigerating chamber 12 and the freezing chamber 13 can be opened and closed by a rotation operation of the refrigerating chamber door 21 and the freezing chamber door 22.

A plurality of drawers 14 and shelves 15 may be provided in the refrigerating chamber 12 and the freezing chamber 13 and a plurality of door baskets 23 may be provided on rear surfaces of the refrigerating chamber door and the freezing chamber door 22 so that food can be accommodated in the inside of the refrigerator.

In addition, although it is not illustrated, a machine room may be formed in a lower portion of the cabinet 10, which is an independent space partitioned from the storage space. A portion of a component which constitutes a refrigeration cycle including a compressor, a condenser, and a condenser fan can be disposed in an inside of the machine room.

Figure 3:
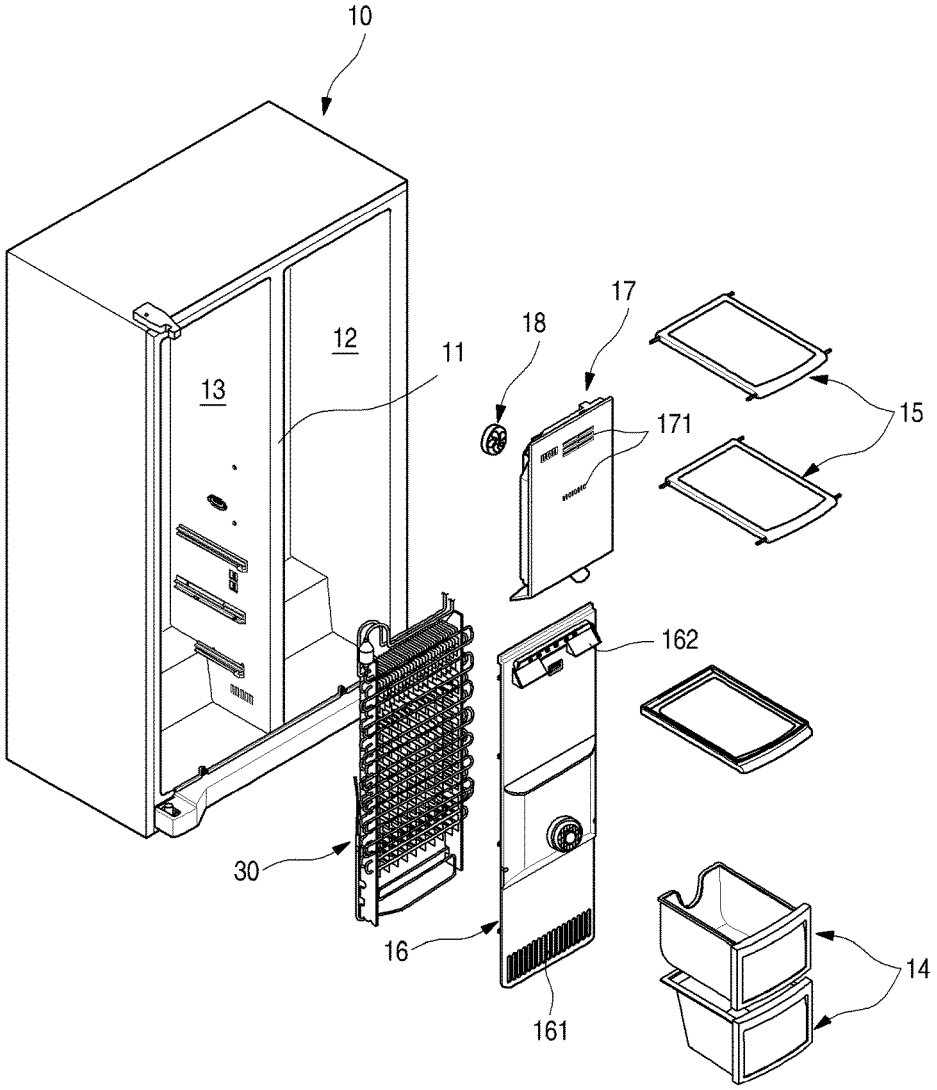
FIG. 3 is an exploded perspective view illustrating a freezing chamber side of the refrigerator.

FIG. 3 is an exploded perspective view illustrating a freezing chamber side of the refrigerator.

As illustrated in the drawing, an evaporator 30 may be provided inside the freezing chamber 13. In addition, a grill fan 16 may be provided in front of the evaporator 30. The grill pan 16 may form a rear wall surface of the freezing chamber 13 and may be configured to shield the evaporator 30.

A suction port 161 is formed in the lower portion of the grill pan 16 to suck in air in the refrigerator. The sucked air can be cooled while passing through the evaporator 30. The grill pan 16 may be provided with a separate discharge port 162 or a fan motor for rapid cooling if necessary.

An upper grill pan 17 may be provided above the grill pan 16 and an evaporator fan 18 may be provided behind the upper grill pan 17. Air can be introduced from the suction port 161 by driving the evaporator fan 18. The upper grill pan 17 may be provided with a discharge port 171 for supplying cool air to the inside of the refrigerator.

Therefore, when the evaporator fan 18 is operated, cool air inside the freezing chamber can be introduced into the suction port 161. The cool air that has been cooled while passing through the evaporator 30 and then flows upward through the evaporator 30 can be supplied into the freezing chamber 13 through the discharge port 171. By repeating this process, the freezing chamber 13 can maintain a set temperature and cool the stored food.

If necessary, the cool air generated by the evaporator 30 is selectively supplied to a refrigerating chamber 12 side according to opening and closing of a damper on a flow path communicated with the refrigerating chamber 12 so that the refrigerating chamber 12 is maintained at a set temperature.

Figure 4:
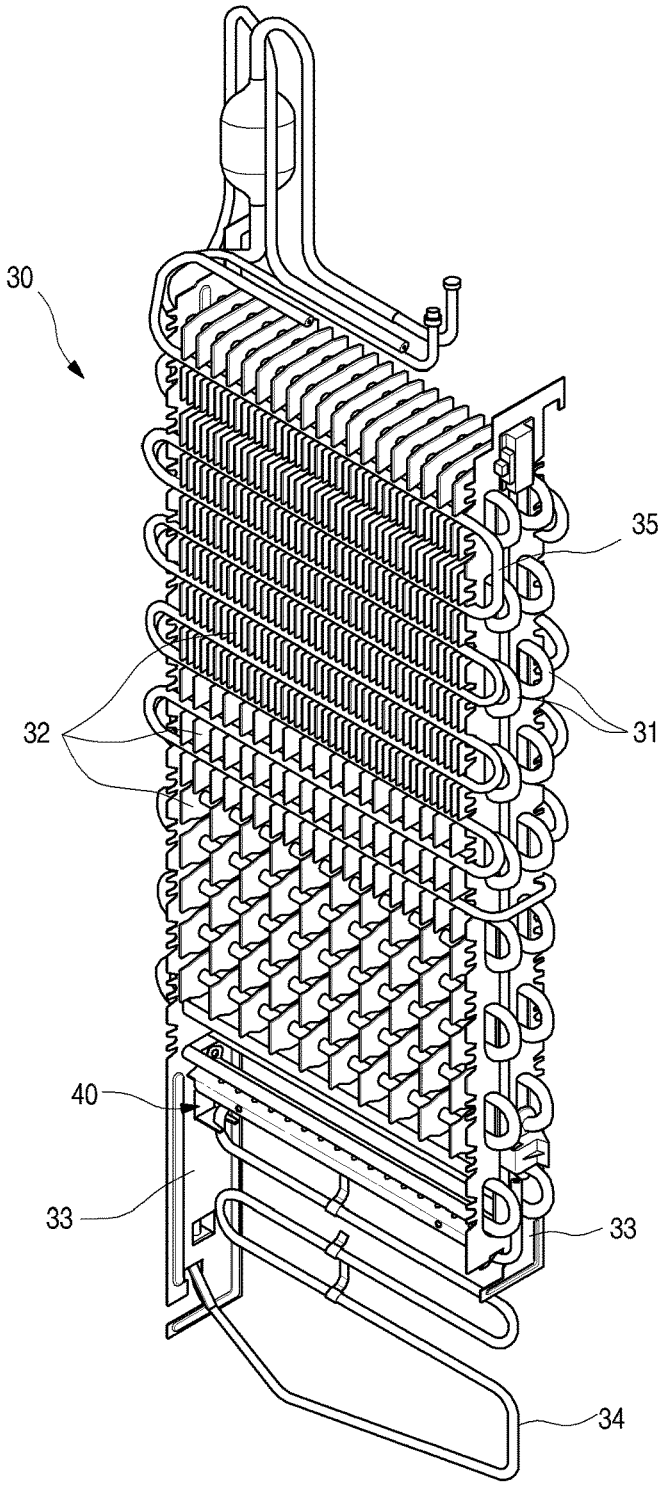
FIG. 4 is a perspective view illustrating an evaporator according to a first embodiment of the present invention.
Figure 5:
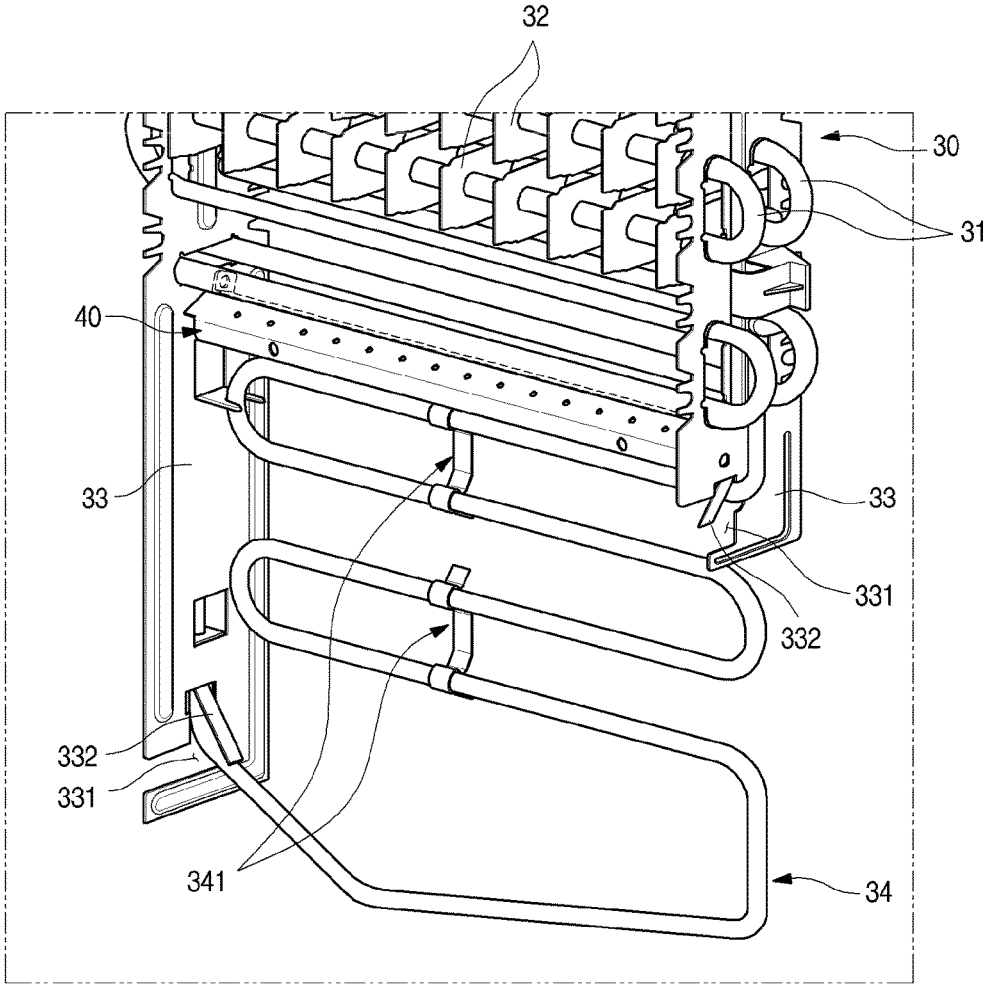
FIG. 5 is a partial perspective view illustrating the evaporator.
Figure 6:
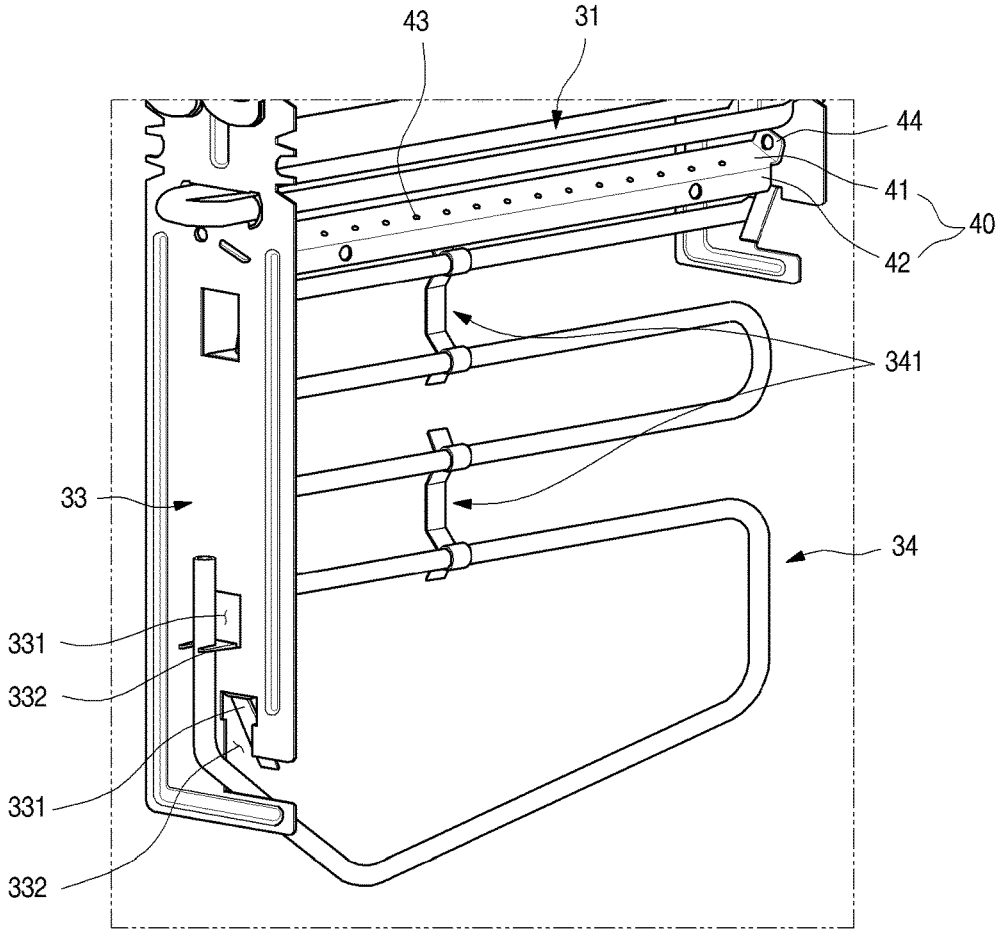
FIG. 6 is a partial perspective view illustrating the evaporator as viewed from the other side.

FIG. 4 is a perspective view illustrating an evaporator according to a first embodiment of the present invention. FIG. 5 is a partial perspective view illustrating the evaporator. FIG. 6 is a partial perspective view illustrating the evaporator as viewed from the other side.

As illustrated in the drawings, the evaporator 30 generates cool air for cooling in the refrigerator and can include a refrigerant pipe 31 through which the refrigerant flows, a plurality of heat exchange fins 32 that passes through the refrigerant pipe 31, a frame 33 that supports the refrigerant pipe 31, a defrost heater 34 and an auxiliary defrost heater 35 that removes frost attached on the evaporator 30.

In more detail, the refrigerant pipe 31 is one through which a low-temperature, low-pressure, and liquid-state refrigerant supplied from the expansion valve flows and cool air can be generated by a process that the refrigerant in the refrigerant pipe 31 exchanges heat with air in the refrigerator and thus is vaporized.

The refrigerant pipe 31 can be formed to extend in the vertical direction by repeating continuously a shape in which both side ends thereof are bent in opposite directions. Accordingly, the refrigerant pipe 31 may have a shape that extends in the vertical direction while being bent in both ends thereof as a whole.

The heat exchange fin 32 is penetrated by the refrigerant pipe 31 and one heat exchange fin 32 may be formed to be penetrated by the refrigerant pipe 31 disposed in the vertical direction a plurality of times. The heat exchange fins 32 are provided to increase the contact area of air for heat exchange and a plurality of heat exchange fins 32 may be continuously disposed at fixed intervals. In other words, the plurality of heat exchange fins 32 may be continuously disposed inside the frame 33 disposed at both ends of the evaporator 30 in the lateral direction in the entire area of the evaporator 30.

disposition interval of the heat exchange fins 32 may be gradually narrowed, as the heat exchange fin goes upward from the lower portion of the evaporator 30. Due to such a structure of the heat exchange fin 32, the flow of the cool air flowing upward from the lower side can be smoothly performed and the generation of the flow loss due to freezing in the lower portion of the evaporator 30 can be prevented.

The overall structure of the evaporator 30 has a vertically lengthened structure and this structure can be mainly used in a side-by-side type refrigerator in which the refrigerating chamber 12 and the freezing chamber 13 are disposed on both sides in the lateral direction.

Since the air flow path in the vertical direction is long due to characteristics of the structure of the evaporator 30, there is a high possibility that attaching and freezing of moisture will occur on the evaporator 30. According to this, the heat exchange efficiency may be lowered and cool air flow loss may be generated.

Therefore, for effective defrosting, the evaporator may have a structure in which defrosting is simultaneously performed on the upper portion and the lower portion of the evaporator 30 during the defrosting operation. In other words, an auxiliary defrost heater 34 which is in direct contact with the evaporator 30 is provided on the upper portion of the evaporator 30 so that the upper portion of the evaporator 30 can be heated by driving the auxiliary defrost heater 34. At the same time, the defrost heater 34 which is spaced apart from the refrigerant pipe 31 is provided at the lower portion of the evaporator 30 so that the lower portion of the evaporator 30 can be heated by radiation and convection.

More specifically, the auxiliary defrost heater 35 is disposed above the defrost heater 34 to be described below in detail and the upper portion of the evaporator 30 is heated to remove frost attached on the evaporator 30.

Both ends of the auxiliary defrost heater 35 may be continuously bent in a shape similar to the shape of the refrigerant pipe 31 and may be disposed on one surface of the evaporator 30. Both ends of the auxiliary defrost heater 35 can be supported by the frame 33.

The auxiliary defrost heater 35 can perform defrosting of the evaporator 30 more quickly during the defrosting operation and can be driven together with the defrost heater 34 to simultaneously defrost the upper portion of the evaporator 30.

Particularly, in a case of the evaporator 30, which is lengthened in the vertical direction as in the embodiment of the present invention, in a case where the defrosting operation is performed using only the defrost heater 34 provided at the lower end thereof, there is a problem that defrosting can take a long time or defrosting of the upper portion of the evaporator 30 cannot be completely performed.

In this case, the upper portion and the lower portion of the evaporator 30 are simultaneously heated by simultaneous driving of the auxiliary defrost heater 35 and thus the defrosting operation can be performed more effectively.

The frame 33 has a plate shape, is disposed on both sides of the evaporator 30 in the lateral direction, and can be extended to be lengthened in the vertical direction. The frame 33 can be configured to support the refrigerant pipe 31 and the auxiliary defrost heater 35 from both sides in the lateral direction.

The frame 33 can be extended downward to be lengthened beyond the position of the refrigerant pipe 31 positioned at the lowermost position and can support the defrost heater 34. The frame 33 may have different lengths at both ends thereof in the lateral direction and the defrost heater 34 can be stably fixed and mounted on the frame by supporting an upper end and a lower end of both side ends of the defrost heat 34 in the lateral direction. Accordingly, in the evaporator 30, the refrigerant pipe 31 on which the heat exchange fin 32 is mounted, the auxiliary defrost heater 35, and the defrost heater 34 can be configured in one module form by the frame 33.

The frame 33 may be formed with a heater fixture 331 through which the both ends of the defrost heater 34 are penetrated and the heater fixture 331 may be formed with a heater supporting portion 332 which supports the defrost heater by bending a portion of the frame 33 which is cut for forming the heater fixture 331.

The defrost heater 34 is operated to remove the frost attached on the evaporator 30 and is operated during the defrosting operation to heat the lower portion of the evaporator 30. The defrost heater 34 may be configured by a sheath heater and may be extended to have a predetermined length and be continuously bent between the frames 33 disposed on both sides thereof.

A plurality of connection members 341 for connecting between the defrost heaters 34 which are continuously bent and disposed in the vertical direction may be provided and at a predetermined interval can be maintained between the bent defrost heaters 34 by the connection member 341.

The defrost heater 34 may be generated heat during the defrosting operation and the heated air may flow upward due to the characteristic of the air flow which flows upward from below to melt frost attached on the evaporator 30. Of course, heat generated in the defrost heater 34 may be transferred to the evaporator 30 by radiation or convection.

On the other hand, a defrost heater cover 40 may be provided between the defrost heater 34 and the refrigerant pipe 31. The defrost heater cover 40 may be configured to prevent the defrost water falling from above from being directly in contact with the defrost heater 34 when the defrost heater 34 is operated.

Both ends of the defrost heater cover 40 can be fixed to and mounted on the frame 33 and the defrost heater cover 40 can be inclined to both sides about a center portion so that the defrost water can be guided outwardly and then fall downward. A plurality of air holes 43 are formed in the defrost heater cover 40 so that the heat heated by the defrost heater 34 is easily transferred upward.

The defrost heater cover 40 is disposed in a space between the defrost heater 34 and the lower end of the refrigerant pipe 31 and is spaced apart from the defrost heater 34 and the refrigerant pipe 31 at an appropriate interval.

More specifically, the defrost heater cover 40 may be disposed on an upper side which is spaced apart from the defrost heater 34 by 2 cm to 10 cm. In a case where the defrost heater cover 40 has an interval of less than 2 cm from the defrost heater 34, the defrost heater 34 and the defrost heater cover 40 are brought too close to each other and the heat of the defrost heater 34 cannot effectively perform convection and radiation and thus defrosting operation efficiency can be lowered.

On the other hand, in a case where the defrost heater cover 40 has an interval exceeding 10 cm from the defrost heater 34, the entire defrost heater 34 cannot be covered from above and the defrost water falling down along the defrost heater cover 40 can fall to the lower end of the defrost heater 34.

In other words, due to the characteristic of the installation structure of the refrigerator 1, the refrigerator has a slightly inclined state such that the front half of the cabinet 10 is positioned to be higher than the rear half thereof and accordingly the refrigerator door 20 has a structure that can be rotated by own weight thereof and be closed.

With such a structure described above, an upper end of the defrost heater 34 which is extended vertically is positioned at the front side of a lower end thereof and in a case where the defrost heater cover 40 is excessively moved away from the upper end of the defrost heater 34, the defrost heater cover 40 cannot cover the lower end of the defrost heater 34 and thus the falling defrost water may be in contact with the lower end of the defrost heater 34.

Therefore, it is preferable that the defrost heater cover 40 is positioned within 10 cm from the defrost heater 34.

Hereinafter, the structure of the defrost heater cover 40 will be described in more detail with reference to the drawings.

Figure 7:
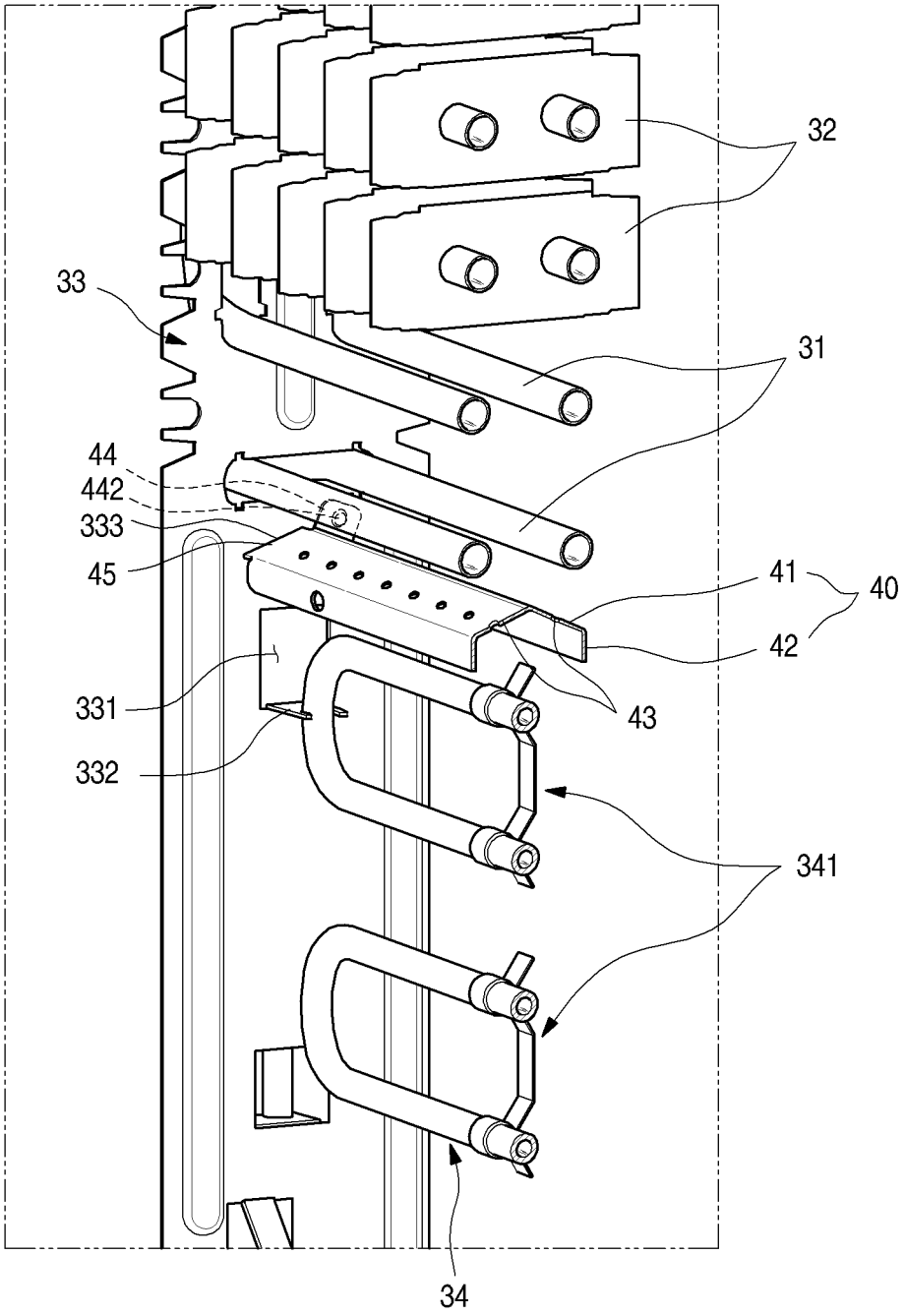
FIG. 7 is a cutaway perspective view illustrating the evaporator.
Figure 8:
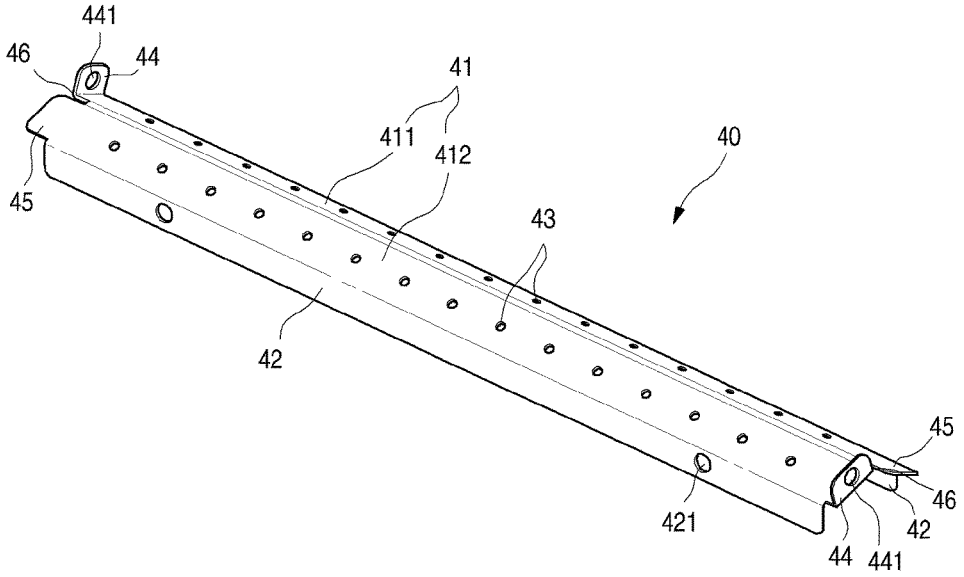
FIG. 8 is a perspective view illustrating a defrost heater cover according to a first embodiment of the present invention.
Figure 9:
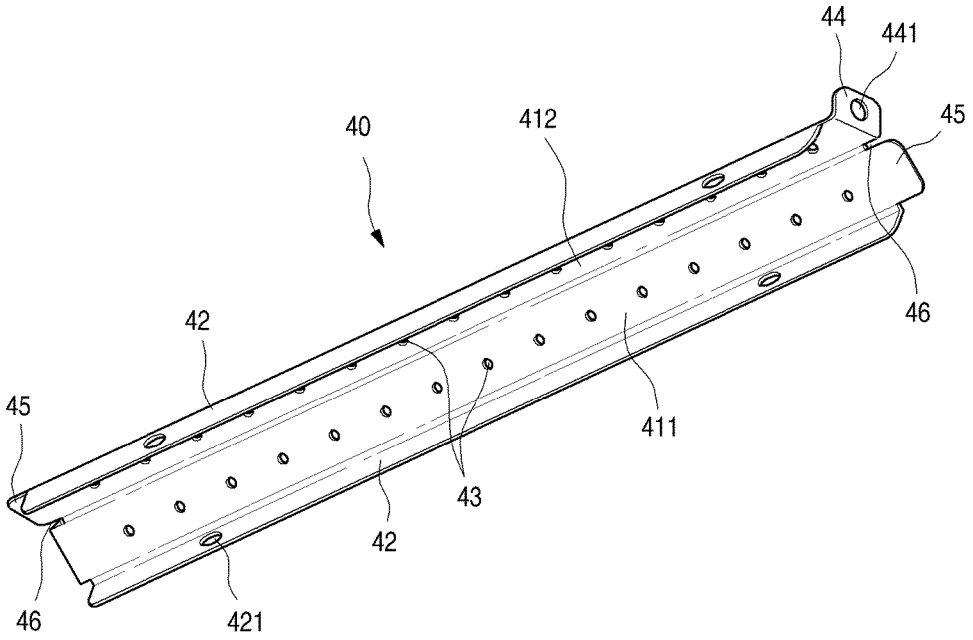
FIG. 9 is a perspective view illustrating the defrost heater cover as viewed from the other side.

FIG. 7 is a cutaway perspective view illustrating the evaporator. FIG. 8 is a perspective view illustrating a defrost heater cover according to a first embodiment of the present invention. FIG. 9 is a perspective view illustrating the defrost heater cover as viewed from the other side.

As illustrated in the drawings, the defrost heater cover 40 may have a plate shape and may extend to a length that can be fixed to both ends of the frame 33. The defrost heater cover 40 may be formed of the same material as the frame 33, the heat exchange fin 32, and the refrigerant pipe 31 which constitute the evaporator 30 and may be formed of the same aluminum alloy material so that generation of galvanic corrosion can be prevented.

The defrost heater cover 40 may include an inclined portion 41 forming an upper surface and an extension portion 42 extending downward from both ends of the inclined portion 41. Both ends of the defrost heater cover 40 can be fixed to and mounted on the frame 33.

The inclined portion 41 forms an upper surface of the defrost heater cover 40 and may form a first inclined surface 411 and a second inclined surface 412 about the center of the inclined portion. The first inclined surface 411 and the second inclined surface 412 formed on both sides may be formed such that a portion where the first inclined surface 411 and the second inclined surface 412 are in contact with each other is positioned above and the extended outer ends may be formed to be inclined downward.

The angle between the first inclined surface 411 and the second inclined surface 412 may be formed to have about 120 to 130°. In a case where the angle between the first inclined surface 411 and the second inclined surface 412 is less than 120°, there is a problem that the height of the defrost heater cover 40 increases to interfere with the upper refrigerant pipe 31 and in a case where the angle between the inclined surface 411 and the second inclined surface 412 is greater than about 130°, there is a problem that it is difficult to smoothly guide the falling defrost water or the frost that falls during the defrosting operation may be accumulated on the inclined portion 41.

The center portion of the inclined portion 41 where the first inclined surface 411 and the second inclined surface 412 are in contact with each other can be positioned vertically above the center portion of the defrost heater 34 and can be formed along the longitudinal direction of the defrost heater 34. Flow of the defrost water to the defrost heater 34 can be prevented by the defrost water falling from above by the inclination of the inclined surfaces 411 and 412 flowing down along the first inclined surface 411 and the second inclined surface 412 and falling from the ends of the first inclined surface 411 and the second inclined surface 412.

On the other hand, a plurality of air holes 43 may be formed in the inclined portion 41. The air holes 43 may be formed in both the first inclined surface 411 and the second inclined surface 412 and a plurality of the air holes 43 may be continuously formed at predetermined intervals along the longitudinal direction in which the defrost heaters 34 extends.

The distance between the air holes 43 formed in the first inclined surface 411 and the second inclined surface 412 respectively may be greater than the thickness of the defrost heater 34. Therefore, even if the defrost water falls through the air hole 43, the defrost water can be prevented from directly contacting the defrost heater 34.

On the other hand, the air hole 43 may have a diameter of about 1 mm to 3 mm. Accordingly, when the defrost water falling on the inclined portion 41 moves along the first inclined surface 411 and the second inclined surface 412, heat can flow upward through the air hole 43 while falling of the defrost water through the air hole 43 can be prevented.

In other words, when the diameter of the air hole 43 is approximately 1 mm or more and the heat generated in the defrost heater 34 flows upward by the driving of the evaporator fan 18, the heat can flow smoothly upward by passing through the air hole 43. At this time, in a case where the diameter of the air hole 43 is smaller than 1 mm, the flowing air cannot easily pass through the air hole.

On the other hand, even if the diameter of the air hole 43 is about 3 mm or less so that the defrost water flowing along the first inclined surface 411 and the second inclined surface 412 is positioned in the air hole 43, water droplets is formed in an inside of the air hole 43 by the surface tension thereof and thus the defrost water does not fall through the air hole 43 but flows down along the first inclined surface 411 and the second inclined surface 422. At this time, in a case where the diameter of the air hole 43 is larger than 3 mm, the defrost water may fall downward without being formed in the air hole 43.

At both ends of the inclined portion 41, an extension portion 42 extending downward may be formed. The extension portion 42 guides water flowing down along the inclined portion 41 to fall downward by being bent downward from the extended ends of the first inclined surface 411 and the second inclined surface 412.

To this end, the extension portion 42 may be formed to be perpendicular to the ground or the bottom surface of the refrigerator 1. The extension portion 42 guides the water flowing along the slope portion 41 so as to vertically fall downward in a region outside the defrost heater 34.

In detail, the cabinet 10 is installed in a state where a front half portion thereof is disposed to be inclined to a somewhat higher position so that the refrigerator door 20 in an opened state can be automatically closed in a state where no external force is applied thereto. Therefore, there is a possibility that the defrost water falling from the defrost heater cover 40 comes into contact with the lower portion of the defrost heater 34 which extends downward.

Accordingly, the extension portion 42 guides the defrost water from the end of the inclined portion 41 to the outside of the defrost heater 34. The extension portion 42 may be bent vertically downward at the end portion of the inclined portion 41 so that the defrost water falling on the defrost heater 34 disposed in the vertical direction is not in contact with the extension portion.

On the other hand, a pair of fixed portion 44 and an insertion portion 45 may be formed on both sides of the defrost heater 34 in the lateral direction. The fixed portion 44 may be formed at one end of the first inclined surface 411 and may be bent upward perpendicular to the first inclined surface 411. The fixed portion 44 may be formed with a fastening hole 441 through which a fastening member 442 such as a screw is fastened. Accordingly, the coupling member 442 can be fastened through the fastening hole 441 and the frame 33 in order and one end of the defrost heater 34 can be fixed to the frame 33.

On the other hand, an insertion portion 45 may be formed at one end of the second inclined surface 412 on both sides thereof. The insertion portion 45 may be formed to be further protruded from the end portion of the second inclined surface 412 and may be narrower than the width of the second inclined surface 412. The insertion portion 45 may be inserted into an insertion port 333 of the frame 33.

The insertion port 333 may be formed to have a size corresponding to the insertion portion 45. Therefore, the frame 33 can support the end portion of the second inclined surface 412 in a state where the insertion portion 45 is inserted into the insertion port 333. The insertion portion 45 is first inserted into the insertion port 333 to assemble the defrost heater cover 40 so that the defrost heater 34 is inserted into the fastening hole 441 in a state where the defrost heater 34 is temporarily assembled, the coupling member 442 is fastened to the frame 33 through the fastening hole 441, and thus the fixing and mounting operation of the defrost heater cover (40) is performed.

On the other hand, the insertion portion 45 and the fixed portion 44 formed at both ends of the defrost heater cover 40 in the lateral direction may be disposed such that positions thereof are positioned to be staggered from each other. Specifically, as illustrated in FIG. 8, a fixed portion 44 may be formed at the end portion of the first inclined surface 411 at the left side end of the defrost heater cover 40 and an insertion portion 45 may be formed at the end portion of the second inclined surface 412. An insertion portion 45 may be formed at an end portion of the first inclined surface 411 at the right side end of the defrost heater cover 40 and a fixed portion 44 may be formed at an end portion of the second inclined surface 412. Due to the staggered arrangement of the insertion portion 45 and the fixed portion 44, the defrost heater cover 40 can have a stable mounting structure without being rotated by a minimum mounting structure.

A cutout portion 46 which is recessed inward may be formed between the insertion portion 45 and the fixed portion 44. The cutout portion 46 may be cut to a predetermined length along between the first inclined surface 411 and the second inclined surface 412 which are in contact with each other. Therefore, it is possible to more easily perform the bending of the inclined portion 41 and the bending operation of the fixed portion 44 and to prevent the defrost heater cover 40 from being damaged or defective during the bending process.

The extension portion 42 may be formed with a bracket mounting portion 421 on which a cover bracket 60 for mounting the defrost heater cover 40 can be hooked and mounted. In the bracket mounting portion 421, the cover bracket 60 to be described in detail in the fifth embodiment below is coupled to the defrost heater cover 40 by using a coupling member 62 fastened to the bracket mounting portion 421 and the defrost heater cover 40 may be hooked and mounted on the refrigerant pipe 31 by the cover bracket 60.

Hereinafter, defrost water flowing state of the refrigerator according to the embodiment of the present invention having a structure described above will be described in detail with reference to the accompanying drawings.

Figure 10:
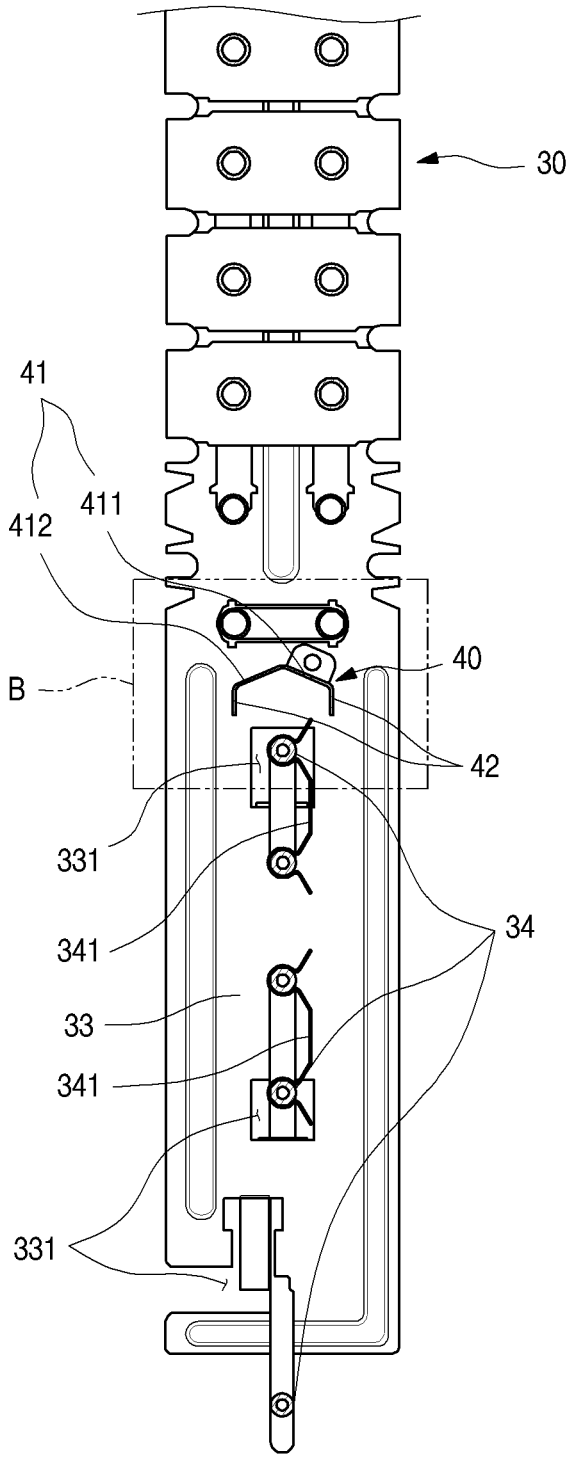
FIG. 10 is a longitudinal sectional view illustrating flow of frost water in a steam evaporator.
Figure 11:
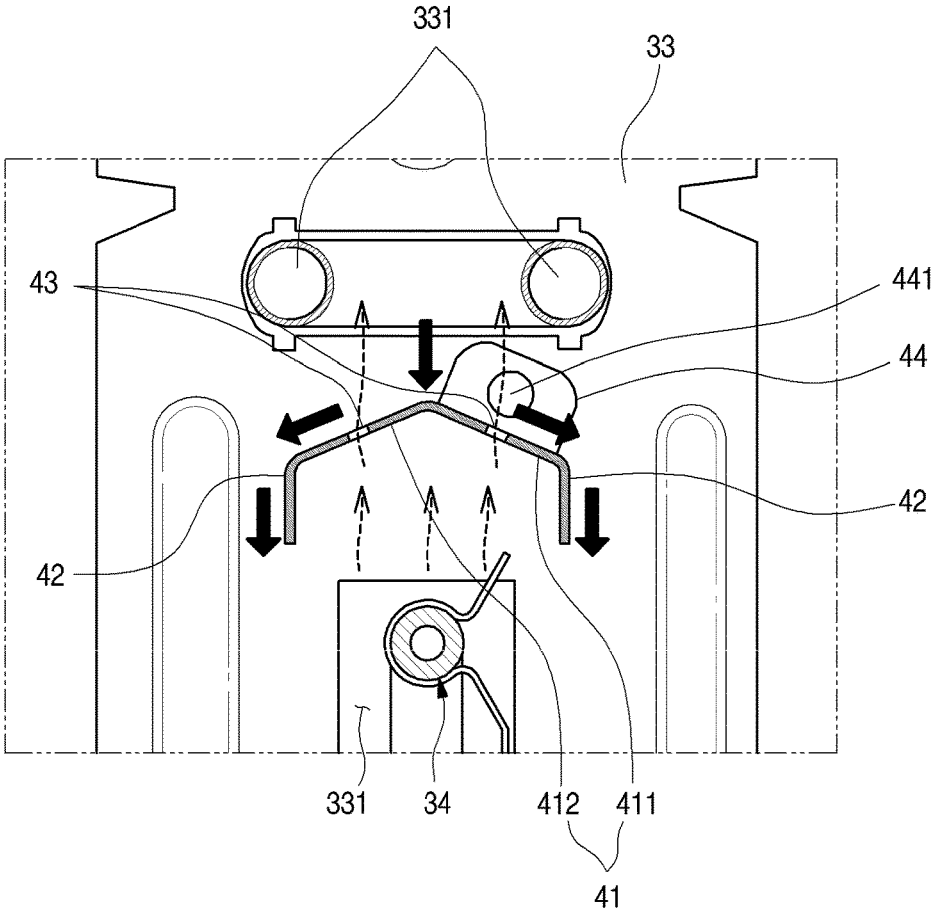
FIG. 11 is an enlarged view of a portion B in FIG. 10.

FIG. 10 is a longitudinal sectional view illustrating the flow of the defrost water in the steam evaporator. FIG. 11 is an enlarged view of a portion B in FIG. 11.

As illustrated in the drawings, in a case where frost is formed on the evaporator 30 during operation of the refrigerator 1, defrosting operation is started. The defrost heater 34 and the auxiliary defrost heater 35 are operated to simultaneously heat the upper portion and the lower portion of the evaporator 30 during defrosting operation and by driving the evaporator fan 18, the entirety of the evaporator 30 can be uniformly heated to melt the frost while heat is transferred from the lower side to the upper side.

During the defrosting operation process, the defrost water which is generated while the defrost is melted and flows downward. At this time, in a state where the length of the evaporator 30 is lengthened vertically and the defrost heater 34 and the auxiliary defrost heater 35 are simultaneously driven, a large amount of defrost water can flow down.

The defrost water falling downward can be hit by the defrost heater cover 40 and can be guided to both sides while flowing along the inclined portion 41. Then, the defrost water flows downward along the extension portion 42 through the inclined portion 41 and finally falls down from the outside of the defrost heater 34.

The defrost water flowing down along the inclined portion 41 passes through the air hole 43. The defrost water passing through the air hole 43 does not pass through the air hole 43 due to the surface tension thereof and can flow down along the inclined surface 51. In addition, penetration of the defrost water in the air hole 43 can be prevented using air flow passing through the air hole 43 from the lower side to upper side by air flowing in the upper direction according to the driving of the evaporator fan 18.

Therefore, the defrost water falling downward can be discharged after falling downward all without being in contact with the defrost heater 34. Particularly, the defrost water falling vertically from the outside of the defrost heater 34 by the extension portion 42 can fall further outward than the lower portion of the defrost heater 34 disposed vertically to be lengthened.

In this way, all the defrost water falling in the process of the defrosting operation can be guided to the outside of the defrost heater 34 and the contact with the defrost heater 34 and the defrost heater can be prevented. Therefore, the noise generated by the defrost water and the defrost heater 34 being in contact with each other can be prevented.

During the defrosting operation, the air forced upward by the driving of the evaporator fan 18 flows upward in a state of being heated by the defrost heater 34. At this time, the air can flow upward through the air hole 43 of the defrost heater cover 40. Therefore, the air flow below the evaporator 30 can be smoothly performed and thus the defrosting operation can be performed more efficiently.

On the other hand, the defrost heater cover 40 according to the embodiment of the present invention may have various other embodiments in addition to the embodiments described above. The configuration of another embodiment of the present invention differs only in a portion of configuration, but other configurations are the same, and a detailed description of the same configuration will be omitted and the same reference numerals will be used for the same configuration.

Hereinafter, another embodiment of the present invention will be described in detail with reference to the drawings.

Figure 12:
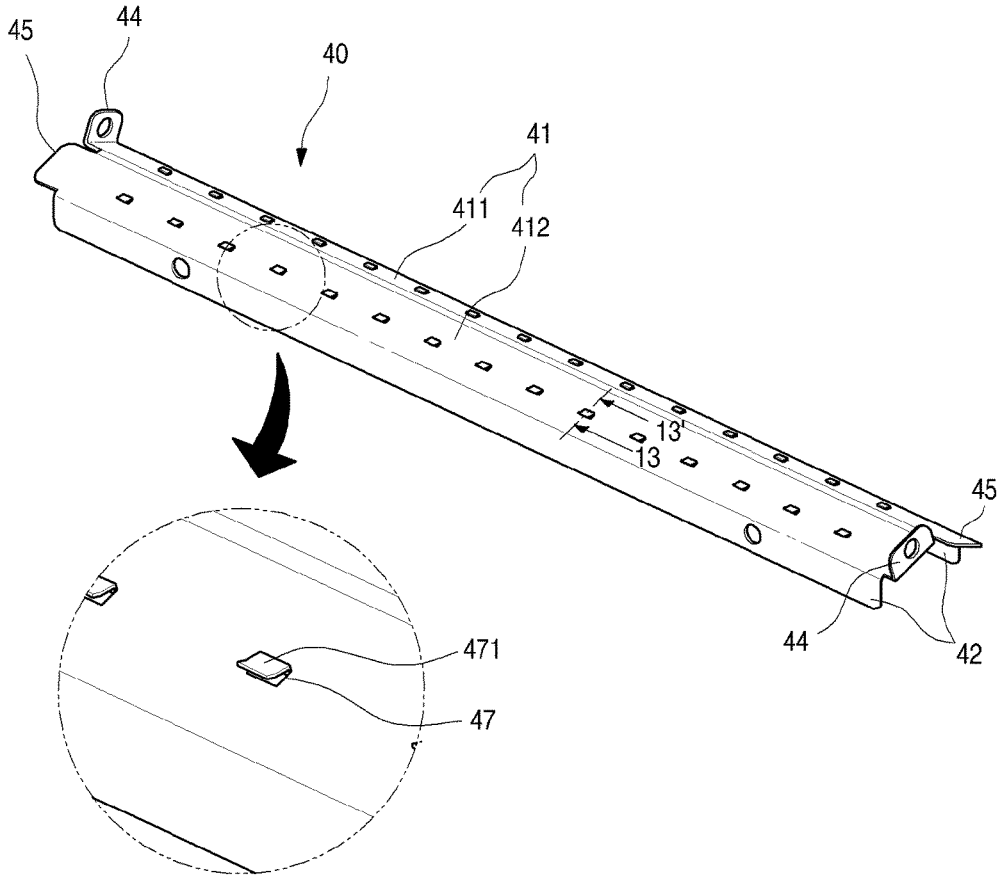
FIG. 12 is a perspective view illustrating a defrost heater cover according to a second embodiment of the present invention.
Figure 13:
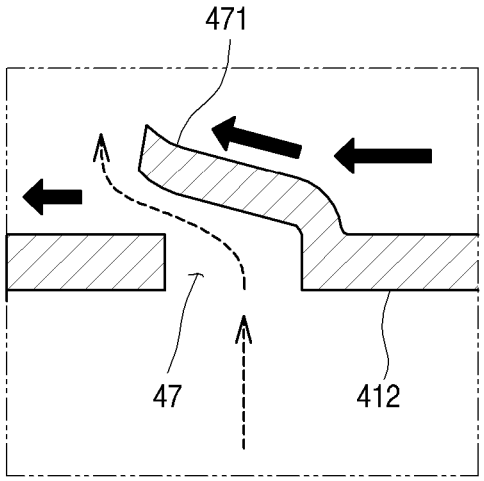
FIG. 13 is a sectional view illustrating FIG. 12.

FIG. 12 is a perspective view illustrating a defrost heater cover according to a second embodiment of the present invention. FIG. 13 is a sectional view of FIG. 12.

As illustrated in the drawings, the defrost heater cover 40 according to the second embodiment of the present invention is formed with an upper surface by the inclined portion 41 and a front surface and a back surface can be formed by the extension portion 42.

The fixed portion 44 and the insertion portion 45 are formed on both ends of the inclined portion 41 in the lateral direction so that the defrost heater cover 40 is fixed to and mounted on the frame 33 from above the defrost heater 34.

On the other hand, the inclined portion 41 may have a downward inclination in both sides direction by the first inclined surface 411 and the second inclined surface 412 forming about the center portion extending in the longitudinal direction. Therefore, the water falling down from above can flow down along the first inclined surface 411 and the second inclined surface 412 and then fall down from the outside of the defrost heater 34.

A plurality of air holes 47 may be formed in the inclined portion 41. The air holes 47 may be opened to have a predetermined size and a plurality of air holes 47 may be formed at fixed intervals along the longitudinal direction of the first inclined surface 411 and the second inclined surface 412.

The air hole 47 may be formed by cutting a portion of the first inclined surface 411 and the second inclined surface 412 and at least a portion of the inclined surfaces 411 and 412 can form a shielding portion 471 by bending upward in order to the air hole 47. The shielding portion 471 shields the air hole 47 from above and is spaced apart from the upper surfaces of the first inclined surface 411 and the second inclined surface 412.

Therefore, it is possible to prevent the water falling down from above the defrost heater cover 40 from introducing into the air hole 47, and the heated air flowing upward from below the defrost heater cover 40 can flow upward through the air hole 47.

On the other hand, the size and shape of the air hole 47 and the shielding portion 471 may be variously changed. For example, the air hole 47 and the shielding portion 471 may be formed in a direction intersecting the extending direction of the defrost heater cover 40.

Figure 14:
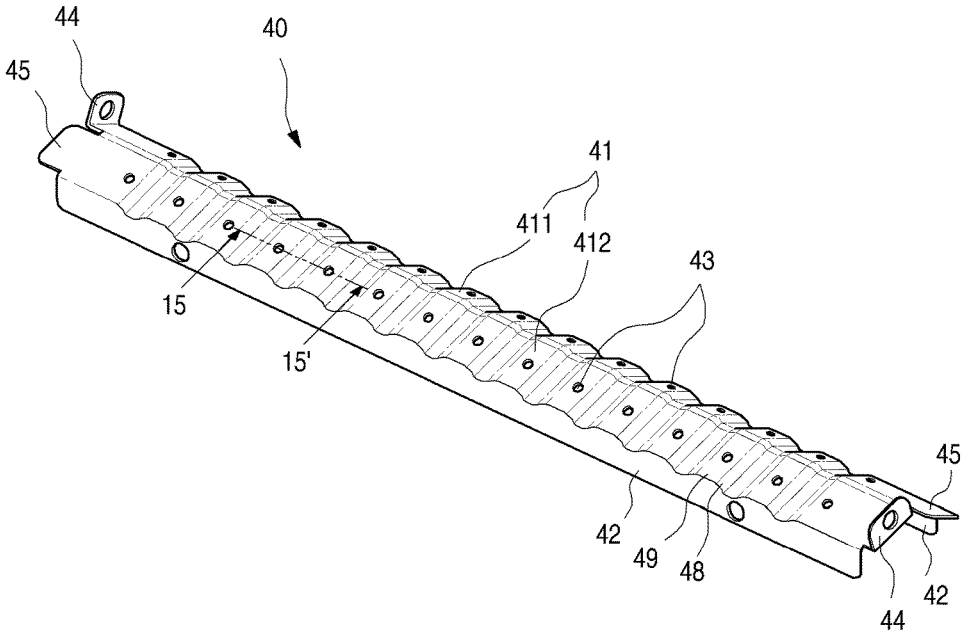
FIG. 14 is a perspective view illustrating a defrost heater cover according to a third embodiment of the present invention.
Figure 15:
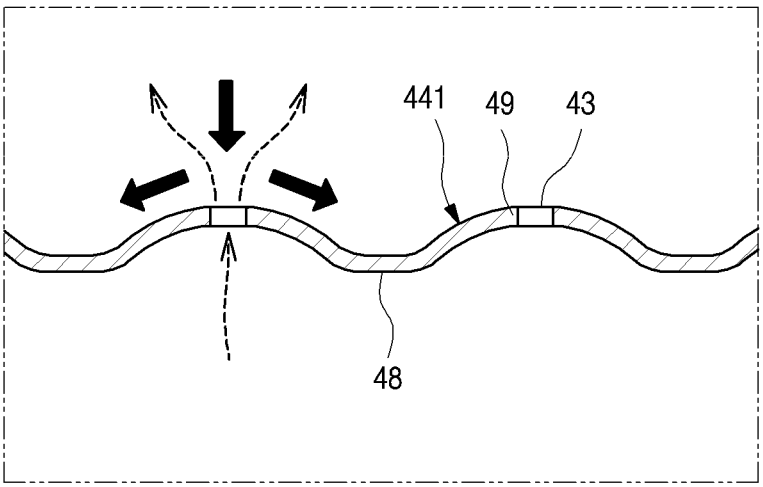
FIG. 15 is a sectional view of FIG. 14.

FIG. 4 is a perspective view illustrating a defrost heater cover according to a third embodiment of the present invention. FIG. 15 is a sectional view of FIG. 14.

As illustrated in the drawings, the defrost heater cover 40 according to the third embodiment of the present invention has an upper surface formed by the inclined portion 41 and the front surface and the rear surface thereof can be formed by the extension portion 42.

The fixed portion 44 and the insertion portion 45 are formed on both ends of the inclined portion 41 in the lateral direction so that the defrost heater cover 40 can be fixed to and mounted on the frame 33 from above the defrost heater 34.

On the other hand, the inclined portion 41 may include a first inclined surface 411 and a second inclined surface 412 which are inclined downward in both directions about a center portion extending in the longitudinal direction. Therefore, the water falling down from above can flow down along the first inclined surface 411 and the second inclined surface 412 and then fall down from the outside of the defrost heater 34.

The first inclined surface 411 and the second inclined surface 412 may have a plurality of recessed portions 48 that are recessed downward. The recessed portion 48 may extend in a direction intersecting a direction in which the defrost heater cover 40 extends and may extend from one end of the first inclined surface 411 to the other end of the second inclined surface 412. Therefore, the water falling into the inclined portion 41 can be guided to the outside of the inclined portion 41 along the recessed portion 48. In other words, the defrost water flowing down to the first inclined surface 411 and the second inclined surface 412 is directed toward the recessed portion 48 and flows along the recessed portion 48 to be guided to the extension portion 42.

A plurality of recessed portions 49 may be formed to be continuously disposed at fixed intervals and a protrusion portion which further relatively protrudes than the recessed portion between the plurality of recessed portions 48 can be formed. The recessed portion 48 and the protrusion portion 49 may be formed to be inclined or rounded and thus in a case where defrost water falls to the protrusion portion 49, defrost water can be guided to the recessed portion 48 along the inclined or rounded surface.

An air hole 43 may be formed in the protrusion portion 49. A plurality of the air holes 43 may be disposed at fixed intervals and one air hole 43 may be formed for each the projection portion 49. The air hole 43 may be formed in a size in which water droplets are not passed by surface tension thereof. The air hole 43 may be formed so that air in a state of being heated while air passes through the defrost heater 34 during driving the evaporator fan 18 can pass therethrough when flowing upward.

Figure 16:
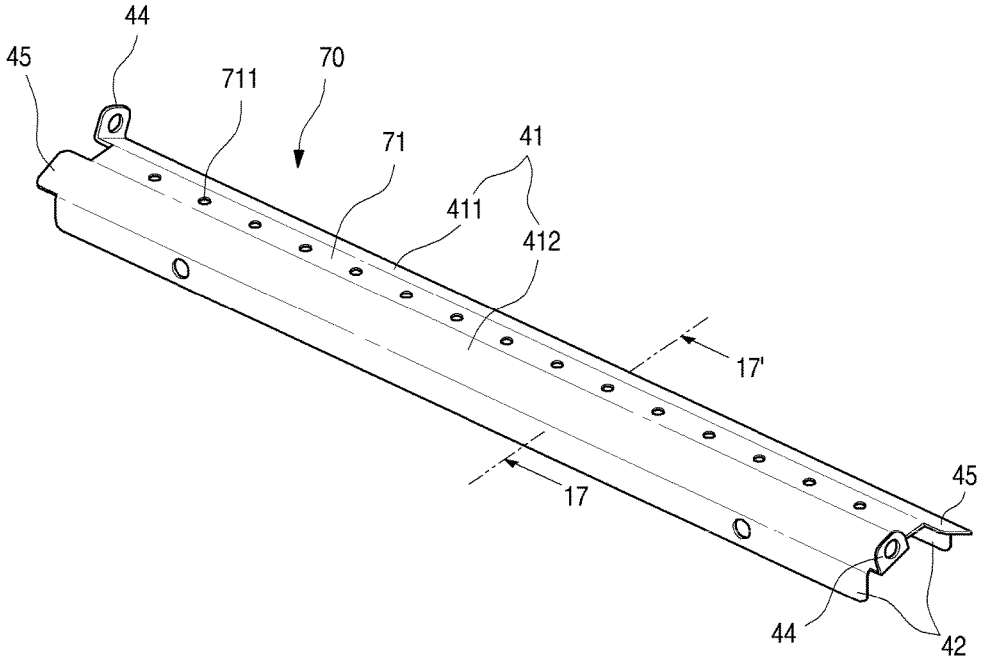
FIG. 16 is a perspective view illustrating a defrost heater cover according to a fourth embodiment of the present invention.
Figure 17:
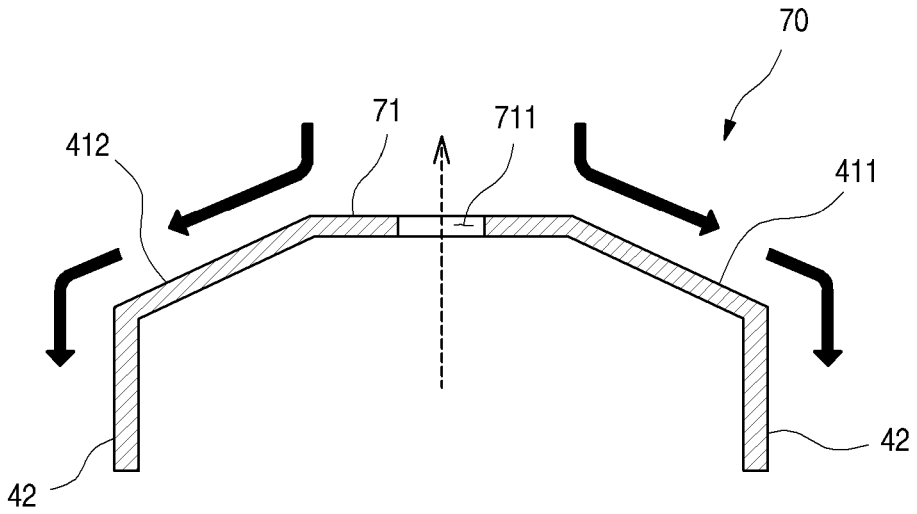
FIG. 17 is a sectional view of FIG. 16.

FIG. 16 is a perspective view illustrating a defrost heater cover according to a fourth embodiment of the present invention. FIG. 17 is a sectional view of FIG. 16.

As illustrated in the drawings, the defrost heater cover 70 according to the fourth embodiment of the present invention has an upper surface which is formed by an inclined portion 41 having a pair of inclined surfaces 411 and 412 and a flat surface portion 41 disposed between the inclined portions 41 and a front surface and a rear surface which are formed by the extension portion 42.

Specifically, the flat surface portion 71 can be formed at the center portion of the defrost heater cover 70. The flat surface portion 71 may be formed to be horizontal to the bottom surface of the refrigerator 1 or the ground surface 1. The flat surface portion 71 may extend along the longitudinal direction of the defrost heater cover 70. In other words, the flat surface portion 71 can be disposed vertically below the refrigerant pipe 31.

The flat surface portion 71 may be formed to have a predetermined width so that the air hole 711 can be disposed. The air holes 711 may be disposed at fixed intervals along the flat surface portion 71 and may be formed to have a size in which the defrost water droplets are not passed by surface tension thereof as in the above embodiment. The air hole 43 may be formed so that air in a state of being heated while air passes through the defrost heater 34 during driving the evaporator fan 18 can pass therethrough when flowing upward.

A fixed portion 44 and an insertion portion 45 are formed at both ends of the inclined portion 41 in the lateral direction so that the defrost heater cover 70 is fixed to and mounted on the frame 33 from above the defrost heater 34.

On the other hand, the inclined portion 41 may include a first inclined surface 411 and a second inclined surface 412 which are inclined downward in both directions about a center portion extending in the longitudinal direction. Therefore, the water falling down from above can flow down along the first inclined surface 411 and the second inclined surface 412 and then fall down from the outside of the defrost heater 34.

The first inclined surface 411 and the second inclined surface 412 may have extension portions at outer ends thereof. The extension portion 42 is bent downward at the end portions of the first inclined surface 411 and the second inclined surface 412 and extends to a predetermined length so that water flowing down along the first inclined surface 411 and the second inclined surface 412 is guided in order to fall outside the defrost heater 34.

Figure 18:
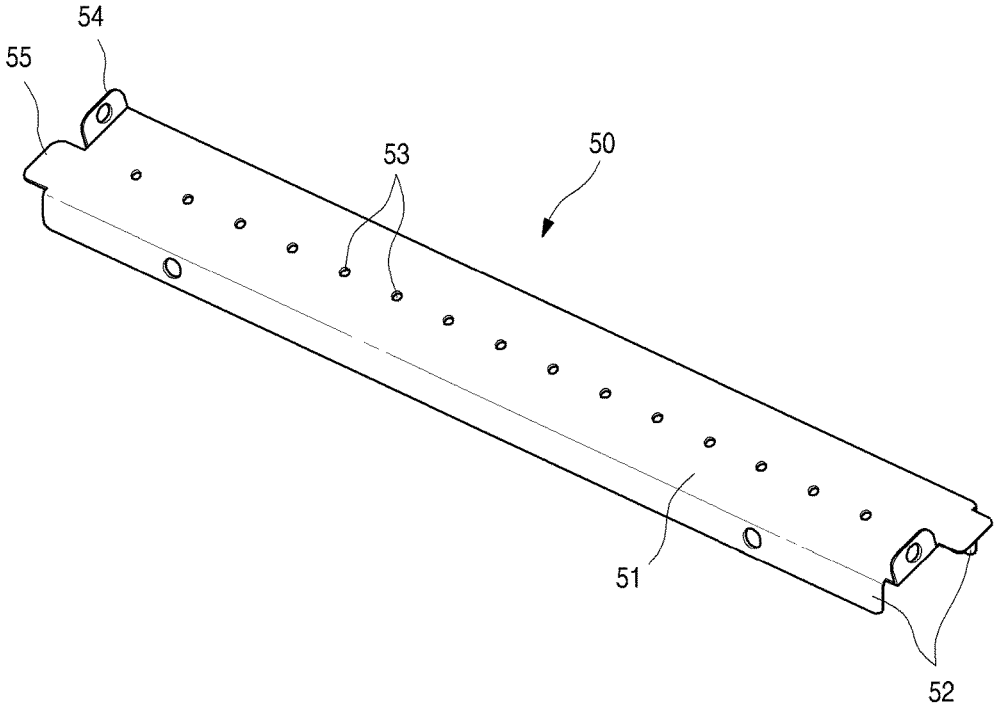
FIG. 18 is a perspective view illustrating a defrost heater cover according to a fifth embodiment of the present invention.
Figure 19:
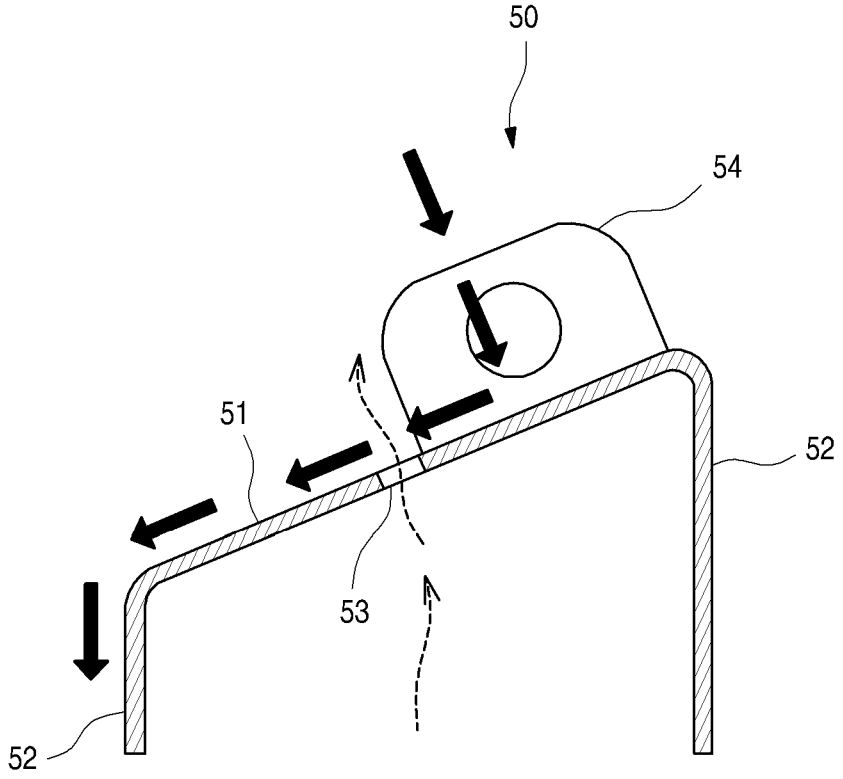
FIG. 19 is a sectional view of FIG. 18.

FIG. 16 is a perspective view illustrating a defrost heater cover according to a fifth embodiment of the present invention. FIG. 19 is a sectional view of FIG. 18.

As illustrated in the drawings, a defrost heater cover 50 according to a fifth embodiment of the present invention has an upper surface formed by an inclined surface 51 and the front surface and the rear surface of the inclined surface 51 by an extension portion 52.

A fixed portion 54 and an insertion portion 55 are formed at both side ends of the inclined surface 51 in the lateral direction so that the defrost heater cover 50 can be fixed to and mounted on the frame 33 from above the defrost heater 34.

On the other hand, the inclined surface 51 may be lengthened to be transverse between the frames 33 and may be inclined to one direction of a front side or a rear side. In other words, the rear end of the inclined surface 51 is formed so as to be higher and be gradually lowered toward the front side so that water falling down from above can be formed to flow down frontward along the inclined surface 51.

The extension 52 may be extended downward at a front end and a rear end of the inclined surface 51 and a plurality of air holes 53 may be formed at the inclined surface 51. The air holes 53 may be continuously disposed at fixed intervals along the inclined surface 51 and may be disposed in two rows. The air holes 53 may be disposed on both sides of the defrost heater 34, respectively. Therefore, even if the water falls through the air hole 53, the water can fall down without being in contact with the defrost heater 34. Of course, the air holes 53 may be disposed in one row or continuously along the inclined surface 51.

Figure 20:
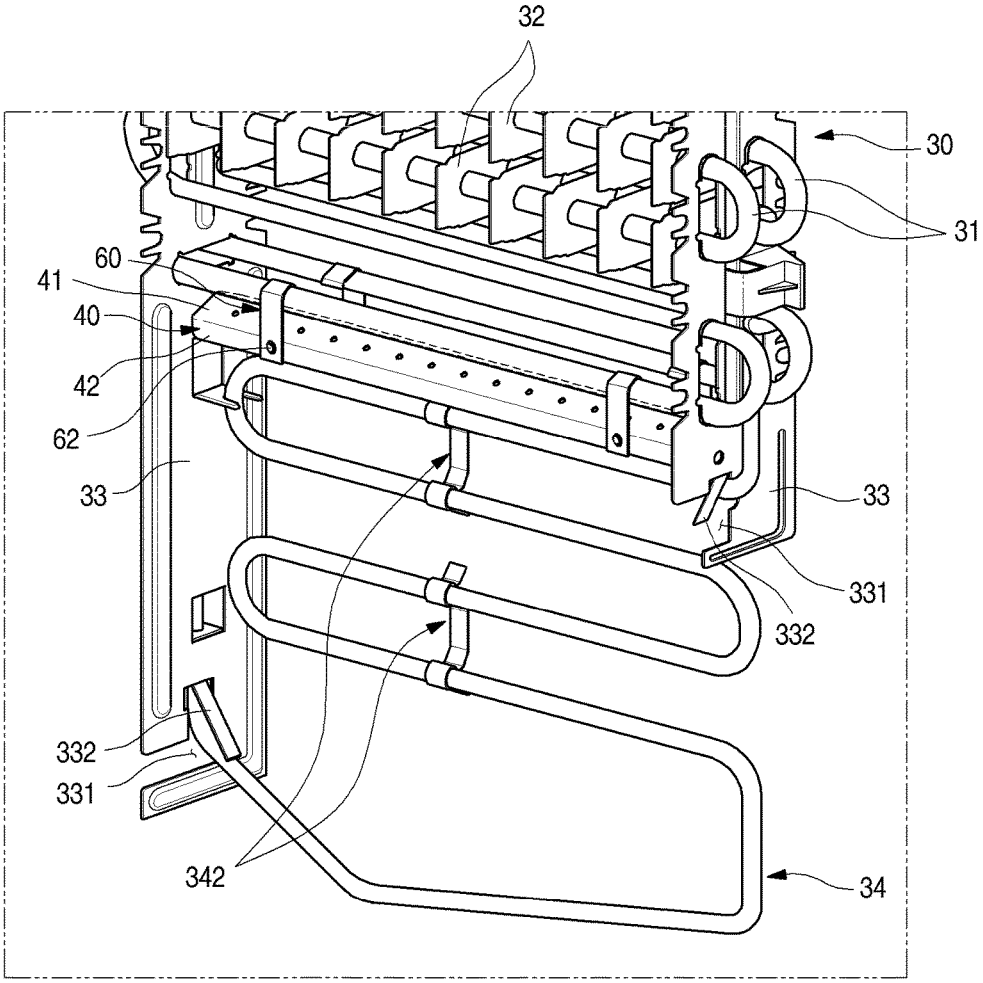
FIG. 20 is a partial perspective view illustrating an evaporator according to a sixth embodiment of the present invention.
Figure 21:
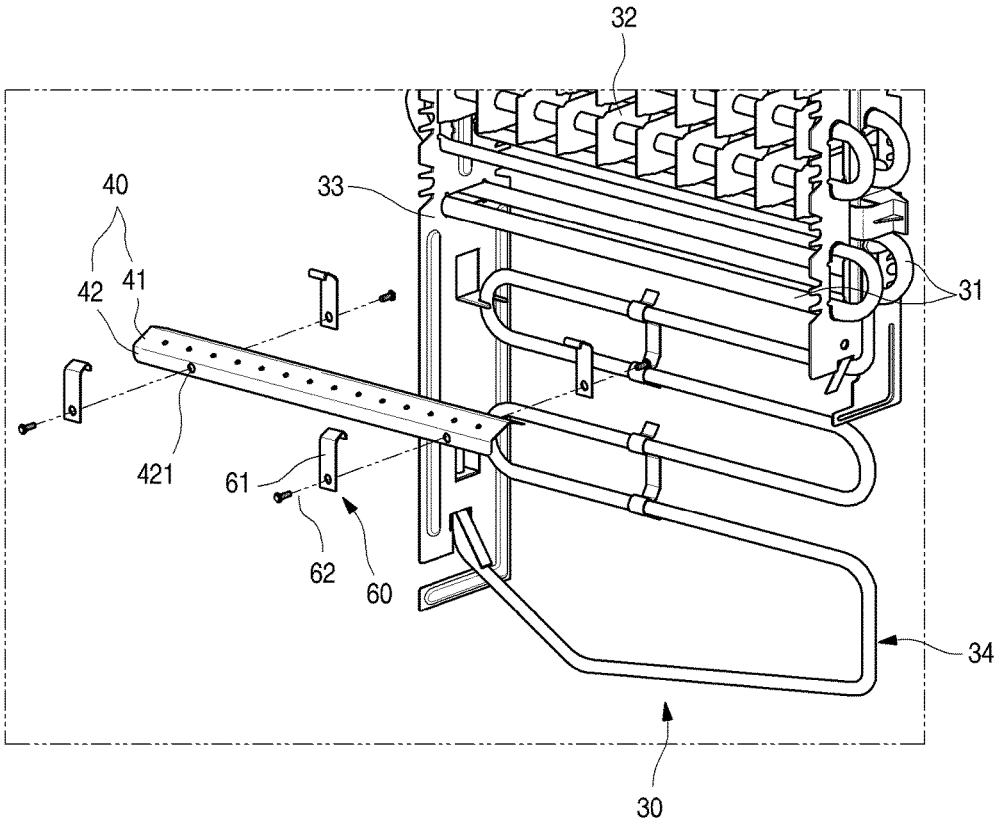
FIG. 21 is an exploded perspective view illustrating a defrost heater cover according to a sixth embodiment of the present invention.

FIG. 20 is a partial perspective view illustrating an evaporator according to a sixth embodiment of the present invention. FIG. 21 is an exploded perspective view illustrating a defrost heater cover according to a sixth embodiment of the present invention.

As illustrated in the drawings, the defrost heater cover 40 according to the sixth embodiment of the present invention may have the same structure as that of the defrost heater cover 40 of any of the embodiments described above. However, the fixed portion 44 and the insertion portion 45 are not formed at both ends of the defrost heater cover 40. Both ends of the defrost heater cover 40 are configured to be in contact with an inside surface of the frame 33, respectively.

A bracket mounting portion 421 may be formed on the extension portion 42 formed at the end portion of the inclined surface 41. The bracket mounting portion 421 is a portion on which a cover bracket 60 for mounting the defrost heater cover 40 is mounted and at least one of bracket mounting portions may be formed on each of the extension portions 42 on both sides thereof.

For example, a hole-shaped bracket mounting portion 421 for fastening a coupling member 62 such as a screw may be formed on the extension portion 42 on both sides thereof. The bracket mounting portion 421 may be formed at positions which are equidistantly spaced apart from both ends of the defrost heater cover 40 so that the defrost heater cover 40 can be stably fixed. The coupling member 62 can be passed through the cover bracket 60 and then fastened to the bracket mounting portion 421 in a state where the cover bracket 60 is positioned at the bracket mounting portion 421.

The lower end of the cover bracket 60 may be coupled to the defrost heater cover 40 and extend upward to the refrigerant pipe 31 positioned at the lowermost end. A hook portion 61 may be formed on the upper end of the cover bracket 60. The hook portion 61 is formed in a hook-like shape and can be hooked and fixed to the refrigerant pipe 31. Therefore, the extended length of the cover bracket 60 is positioned between the defrost heater 34 and the lowermost refrigerant pipe 31 in a state where the defrost heater cover 40 is mounted so that the cover bracket 60 does not interfere with any of the defrost heater 34 and the refrigerant pipe 31.

The defrost heater cover 40 has a structure so that the defrost heater cover 40 can not only simply mount on the evaporator 30 during the manufacturing process of the product but also can be additionally mounted simply by hooking the cover bracket 60 to the evaporator 30 of the refrigerator 1 which is in a state of being sold and installed. Accordingly, the defrost heater cover 40 can be additionally mounted on the refrigerator 1 in a state of being already installed, according to the need of an operator, during the service situation.

What is claimed is:

1. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, and wherein each air hole of the plurality of air holes has a diameter between 1 mm and 3 mm and is configured to restrict flow of defrost water based on surface tension of water.

2. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, and wherein the defrost heater cover includes:

an insertion portion that is located at a side of the defrost heater cover and that inserts into the pair of frames;

a fixed portion that is located at the side of the defrost heater cover, that is bent, and that contacts an inside surface of the pair of frames; and a coupling member that couples the defrost heater cover to the pair of frames through the fixed portion.

3. The refrigerator according to claim 2, wherein the defrost heater cover further includes a cutout portion that defines a space between the insertion portion and the fixed portion and that extends inwardly from the side of the defrost heater cover.

4. The refrigerator according to claim 3, wherein the defrost heater cover further includes:

a center portion that extends in a longitudinal direction of the defrost heater cover; and a pair of surfaces that extend from the center portion in directions opposite to each other and that are inclined downward, and wherein the cutout portion is defined at an end of the center portion.

5. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, and wherein the defrost heater cover includes a pair of extension portions that extend downward and that are configured to guide defrost water to flow downward along the defrost heater cover to an outside of the defrost heater.

6. The refrigerator according to claim 5, wherein the defrost heater cover further includes a cover bracket that couples the defrost heater cover to the refrigerant pipe, and wherein the pair of extension portions define a bracket mounting portion that receives a coupling member for coupling the cover bracket to the defrost heater cover.

7. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, wherein the refrigerator further comprises a cover bracket that extends in a vertical direction and that couples the defrost heater cover to the refrigerant pipe, and wherein the cover bracket includes a lower end coupled to the defrost heater cover and an upper end coupled to the refrigerant pipe.

8. The refrigerator according to claim 7, wherein the cover bracket is detachably coupled to the lower end of the refrigerant pipe.

9. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, wherein the defrost heater cover includes a first inclined surface and a second inclined surface that are inclined symmetrically to each other with respect to a center of the defrost heater, and wherein the plurality of air holes are defined in the first inclined surface and the second inclined surface.

10. The refrigerator according to claim 9, wherein the first and second inclined surfaces respectively include an extended end portion that is positioned outward of an outside of the defrost heater.

11. The refrigerator according to claim 10, wherein the first and second inclined surfaces respectively further include an extension portion that is bent from the extended end portion and that extends downward.

12. The refrigerator according to claim 9, wherein the defrost heater cover has a first side and a second side that face a first inside surface and a second inside surface of the pair of frames, respectively, wherein the first inclined surface includes:

a first insertion portion that is located at the first side of the defrost heater cover and that inserts into the first inside surface of the pair of frames, and a first fixed portion that is located at the second side of the defrost heater cover, that is bent, and that contacts the second inside surface of the pair of frames, and wherein the second inclined surface includes:

a second insertion portion that is located at the second side of the defrost heater cover and that inserts into the second inside surface of the pair of frames, and a second fixed portion that is located at the first side of the defrost heater cover, that is bent, and that contacts the first inside surface of the pair of frames.

13. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, wherein the defrost heater cover includes an inclined surface that is inclined downward to an outside of the defrost heater and that is configured to guide defrost water downward toward the outside of the defrost heater along the inclined surface, and wherein the plurality of air holes are defined in the inclined surface.

14. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, and wherein the defrost heater cover includes a shielding portion that extends from an edge of each air hole of the plurality of air holes to thereby cover at least a portion of each air hole of the plurality of air holes.

15. A refrigerator comprising:

a cabinet defining a refrigerating chamber and a freezing chamber that are arranged in a lateral direction;

a refrigerant pipe disposed at a rear side of the freezing chamber and bent one or more times, the refrigerant pipe extending in a vertical direction;

a plurality of heat-exchange fins through which the refrigerant pipe passes;

a pair of frames spaced apart from each other in the lateral direction and supporting both sides of the refrigerant pipe;

an auxiliary defrost heater provided at an upper portion of the refrigerant pipe and configured to heat an upper region of the refrigerant pipe during a defrosting operation;

a defrost heater disposed below a lower end of the refrigerant pipe and configured to heat the refrigerant pipe and air outside the refrigerant pipe during the defrosting operation; and a defrost heater cover disposed between the defrost heater and the lower end of the refrigerant pipe and covering an upper portion of the defrost heater, wherein the defrost heater cover defines a plurality of air holes that allow air heated by the defrost heater to flow upward to the refrigerant pipe, wherein the defrost heater cover includes:

a flat surface portion that extends in a longitudinal direction of the defrost heater; and inclined portions that extend outward from both sides of the flat surface portion and that slope downward toward an outside of the defrost heater, and wherein the plurality of air holes are defined in the flat surface portion.

16. The refrigerator according to claim 15, wherein the flat surface portion is disposed vertically below the refrigerant pipe and is oriented parallel with a bottom surface of the refrigerator.

17. The refrigerator according to claim 9, wherein the defrost heater cover includes:

a plurality of recessed portions that are recessed downward from an upper side of each of the first inclined surface and the second inclined surface, the plurality of recessed portions being configured to guide the defrost water to the outside of the defrost heater, and wherein the plurality of air holes are defined between the plurality of recessed portions and arranged at a predetermined interval.

18. The refrigerator according to claim 17, wherein the defrost heater cover further includes a plurality of protrusion portions, each protrusion portion being disposed between the plurality of recessed portions and including a portion that is inclined upward or rounded upward from an adjacent recessed portion of the plurality of recessed portions, and wherein the plurality of air holes are defined at protruded end portions of the plurality of protrusion portions.

* * * * *